US006257932B1

(12) United States Patent
Neely

(10) Patent No.: US 6,257,932 B1
(45) Date of Patent: Jul. 10, 2001

(54) KEYED ELECTRICAL CONNECTOR

(75) Inventor: Phillip K. Neely, Terre Haute, IN (US)

(73) Assignees: Sony Corporation, Tokyo (JP); Digital Audio Disc Corporation, Terre Haute, IN (US)

( * ) Notice: Subject to any disclaimer, the term of this patent is extended or adjusted under 35 U.S.C. 154(b) by 0 days.

(21) Appl. No.: 09/562,820

(22) Filed: May 1, 2000

(51) Int. Cl.[7] ..... H01R 25/00
(52) U.S. Cl. ..... 439/638
(58) Field of Search ..... 439/638, 628, 439/620

(56) References Cited

U.S. PATENT DOCUMENTS 4,367,001 * 1/1983 Munakata ..... 439/175
4,494,809 * 1/1985 Soloman ..... 439/369
4,857,014 * 8/1989 Alf et al. ..... 439/578
4,946,396 * 8/1990 Saitoh ..... 439/500
5,593,323 * 1/1997 Dernehl ..... 439/668
6,152,778 * 11/2000 Dalton ..... 439/638

* cited by examiner

*Primary Examiner*—Tulsidas Patel
(74) *Attorney, Agent, or Firm*—Wood, Herron & Evans, L.L.P.

(57) ABSTRACT

An electrical connector includes a first component having a first electrical connecting element. A second component of the electrical connector has a second electrical connecting element connectable to the first electrical connecting element in an electrically conductive relationship and a third electrical connecting element. The electrical connector has a third component with a fourth electrical connecting element connectable to the third electrical connecting element in an electrically conductive relationship. However, the fourth electrical connecting element is not connectable to the first electrical connecting element in an electrically conductive relationship. Thus, as long as the second component is carried with a person, an electrically conductive relationship cannot be established through the electrical connector.

2 Claims, 2 Drawing Sheets

KEYED ELECTRICAL CONNECTOR

FIELD OF THE INVENTION

The present invention generally relates to electrical connectors and ore particularly, to an improved electrical connector.

BACKGROUND OF THE INVENTION

In many industrial environments, it is desirable to exclude persons from selected assembly/manufacturing or other areas to prevent injuries to persons by equipment operating within the area. To effect such exclusion, referring to FIG. 3, a barrier 20, for example a fence, is erected around such an area. The fence normally includes a gate 22 hinged to the fence 20 for providing access to and from the manufacturing area. An electrical female receptacle 24 is attached to a fixed end or post 26 of the fence 20. Electrically and mechanically coupled to the receptacle 24 is a male plug 28 which is also connected to one end of a flexible cable or chain 30. The other end of the chain 30 is rigidly connected to the gate 22 at a location proximate a portion or side of the gate 22 that must be moved in order to enter or leave the area inside a perimeter of the fence. Referring to FIG. 4, the plug 28 is often referred to as a shorting plug because its pins 32 are internally shorted together. Pin sockets 34 inside the receptacle 24 are electrically connected to wires or leads 36. The pin sockets 34 receive the pins 32 of the plug 28 when the plug 28 is mechanically connected to the receptacle 24, thereby providing continuity in a circuit to which the wires 36 are connected. For example, the wires 36 may be connected to one side of a power supply 38 that provides power to manufacturing equipment 40.

Thus, with the gate 22 in its illustrated closed position in FIG. 3 and with the receptacle 24 electrically and mechanically coupled to the plug 28, a closed circuit exists from the power supply 38 and in a circuit formed by the wires 36, the receptacle 24, the shorted pins 32 in the plug 38 and the manufacturing equipment 40. Prior to opening the gate 22, the plug 28 must be disconnected from the receptacle 24, thereby interrupting the continuity of the above-described closed circuit. Thus, with the plug 28 disconnected from the receptacle 24, it is not possible for the power supply 38 to supply power to the manufacturing equipment; and the plug 28 and receptacle 24 function as a manually operable electrical interlock or switch. The gate 22 is then opened, and persons can enter within the perimeter of the fence with little risk of the equipment therein being operated without their knowledge. The receptacle 24 and plug 28 are commercially available as Part Nos. 22801 and 22804, respectively, from Brad Harrison, a David Woodhead Company.

Thus, the known receptacle 24 and plug 28 operate effectively to break circuit continuity prior to the gate 22 being opened. As long as the gate 22 remains open, the plug and receptacle cannot be connected; and the manufacturing equipment within the fence perimeter remain inoperable. However, there is one problem with the known plug and receptacle connector. The manufacturing areas inside the perimeter of the fence 20 may be quite large, and further, the manufacturing equipment within the fence perimeter often hide the presence of persons within the perimeter of the fence. In addition, ambient noise within the manufacturing area often distorts and hides vocal calls and warnings. Thus, it is possible that the gate 22 may be closed and the receptacle 24 and plug 28 reconnected while a person remains within the perimeter of the fence.

Therefore, there is a need for an improved electrical connector that prohibits a connection of the connector if a person remains within the perimeter of the fence.

SUMMARY OF INVENTION

The present invention provides an electrical connector that functions as a manually operable electrical interlock or switch that is a substantial improvement over known electrical interlocks. If properly used, the electrical connector or interlock of the present invention cannot be inadvertently connected or switched while a person remains undetected within the fence perimeter. Thus, the present invention provides a better, more functional, reliable and higher quality connector than known connectors. The invention is especially useful in providing an electrical interlock connector for fences or other barriers that protect a manufacturing area in which the presence of persons is relatively hard to detect.

In accordance with the principles of the present invention and the described embodiments, an electrical connector includes a first component having a first electrical connecting element. A second component has a second electrical connecting element connectable to the first electrical connecting element in an electrically conductive relationship and a third electrical connecting element. A third component has a fourth electrical connecting element connectable to the third electrical connecting element in an electrically conductive relationship, however, the fourth electrical connecting element is not connectable to the first electrical connecting element in an electrically conductive relationship.

In one aspect of the invention, the first electrical connecting element is a female electrical connector; the second electrical connecting element is a male electrical connector; the third electrical connecting element is a female electrical connector; and the fourth electrical connecting element is a male electrical connector.

In a further aspect of the invention, the first electrical connecting element has pin sockets and the second electrical connecting element has pins insertable into the pin sockets as the second electrical connecting element of the second component is connected to the first electrical connecting component of the first component. Further, the third electrical connecting element of the second component has pin sockets and the fourth electrical connecting element of the third component has pins insertable into the pin sockets as the fourth electrical connecting element of the third component is connected to the third electrical connecting component of the second component.

In a still further aspect of the invention, the pins of the fourth electrical connecting element of the third component are electrically connected together.

In another embodiment, the present invention includes a method of limiting access of personnel to an enclosed area by first erecting a barrier around an area having equipment and from which persons are to be barred during operation of the equipment. The barrier includes a gate having a moving side providing access to the area surrounded by the barrier. Next, a receptacle is attached to the barrier, and the receptacle has a first electrical connector connected to a circuit through which conduction is required to operate the equipment. A shorting plug having an electrical connector is attached to the gate. A first electrical connecter of a key coupling is connected to the electrical connector of the receptacle. A second electrical connector of the key coupling is connected to the shorting plug, thereby placing the circuit in an electrically conductive relationship with the receptacle, the key coupling and the plug. The shorting plug not being connectable to the receptacle.

In one aspect of this second embodiment, the electrically conductive relationship in the circuit is interrupted in response to the key coupling being disconnected from either the receptacle or the shorting plug. In another aspect of this second embodiment, the electrically conductive relationship with the circuit is re-established in response to the key coupling being connected to both the receptacle and the shorting plug.

The electrical connector or interlock of the present invention has the advantage of not being able to be inadvertently connected or switched while a person remains undetected within the fence perimeter and thus, is a more reliable and higher quality electrical interlocking connector than known devices.

Various additional advantages, objects and features of the invention will become more readily apparent to those of ordinary skill in the art upon consideration of the following detailed description of the presently preferred embodiments taken in conjunction with the accompanying drawings.

DETAILED DESCRIPTION OF THE INVENTION

Figure 1:
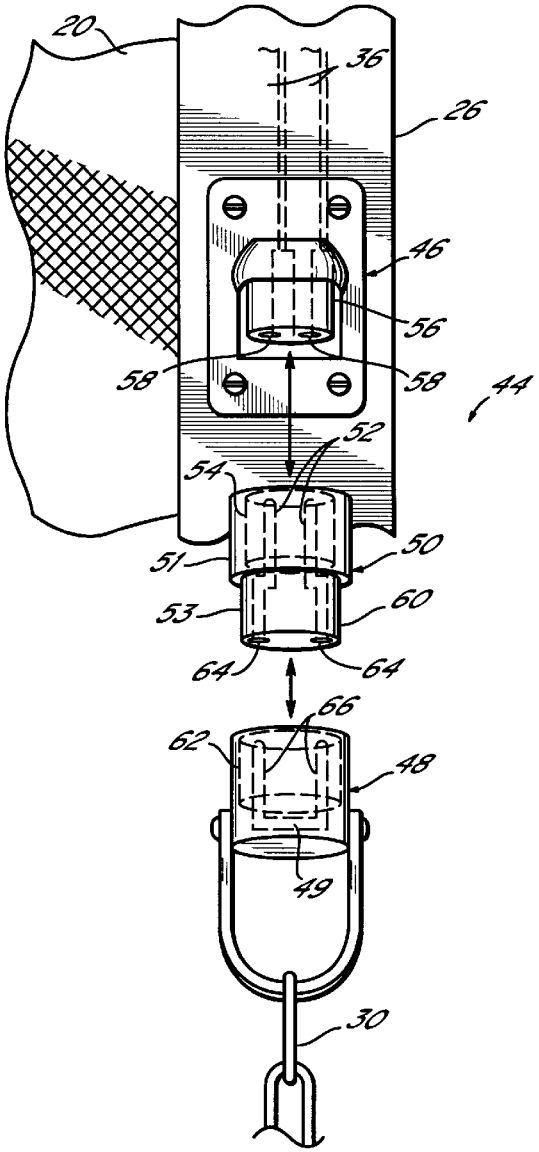
FIG. 1 is a perspective view of one embodiment of an electrical connector in accordance with the principles of the present invention.

Referring to FIG. 1, the present invention utilizes a multiple component, electrical, connector or plug 44. A first component, for example, a female receptacle 46 which may be identical to the receptacle 24 is mechanically attached to a fixed pole 26 of the fence 20. Further, a second component, for example, a male shorting plug 48 is mechanically connected to one end of the chain 30 in a similar manner as the plug 28. The shorting plug 48 has an electrical connecting element comprised of pins 66 that are electrically shorted together by a jumper 49. Intermediate the receptacle 46 and shorting plug 48 is a third component, for example, a key coupling 50 having one electrical connecting element comprised of a male key plug portion 51 on one side or end and another electrical connecting element comprised of a female key receptacle portion 53 on an opposite side or end. The key plug portion 51 has a cavity 54 containing pins 52. The cavity 54 has a cross-sectional profile or shape that is very similar to the cross-sectional profile or shape of the receptacle extension 56, thereby permitting the cavity 54 to receive an electrical connecting element on a distal end of a receptacle extension 56, for example, pin sockets 58. As the key plug cavity 54 receives the receptacle extension 56, the pin sockets 58 of the receptacle 46 receive and connect with the pins 52 of the key coupling 50 in an electrically conductive relationship.

The key receptacle portion 53 has an extension 60 which has a cross-sectional profile or shape that is very similar to the cross-sectional size and shape of the cavity 62 of the shorting plug 48. In addition, the key receptacle portion 53 has pin sockets 64 with a cross-sectional profile that permits the pin sockets 64 to receive and contact the pins 66 of the shorting plug 48 in an electrically conductive relationship. The cross-sectional profile or shape of the cavity 62 is normally different from the cross-sectional profile of the receptacle extension 56, so that the cavity 62 cannot physically receive the extension 56 of the receptacle 46. Similarly, the spacing of the pins 66 is normally different from the spacing of the pin sockets 58. Therefore, in the absence of the key coupling 50, it is physically impossible to mechanically couple and electrically connect the shorting plug 48 with the receptacle 46. However, with the key coupling 50 mechanically coupled to, and electrically connected with, both the receptacle 46 and the shorting plug 48, continuity is provided between the wires or leads 36 of the receptacle 46.

In use, when a person desires to enter the manufacturing area within the perimeter of the fence 20, the key coupling 50 is disconnected from the receptacle 46 and is also removed from the shorting plug 48. The key coupling is then carried by the person entering through the gate 22. Thus, as long as the person remains within the perimeter of the fence 20 and in possession of the key coupling 50, it is physically impossible to interconnect the shorting plug 48 with the receptacle 46 and obtain continuity through the wires 36. Thus, in those situations where it is difficult or impossible to determine whether a person remains within the perimeter of the fence 20, as long as the key coupling 50 is missing from the connector 44, a person at the gate 22 can easily determine that someone remains within the perimeter of the fence 20. Further, in the absence of the key coupling 50, a person at the gate cannot mechanically or electrically connect the shorting plug 48 with the receptacle 46.

Figure 2:
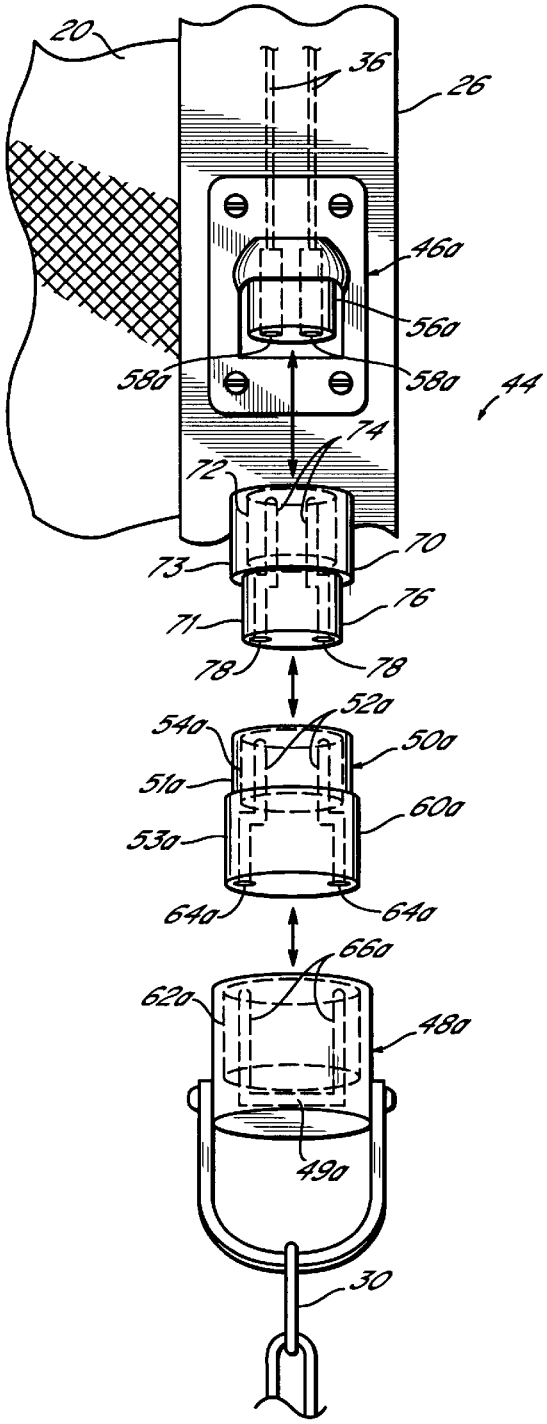
FIG. 2 is perspective view of a second embodiment of an electrical connector in accordance with the principles of the present invention.
Figure 3:
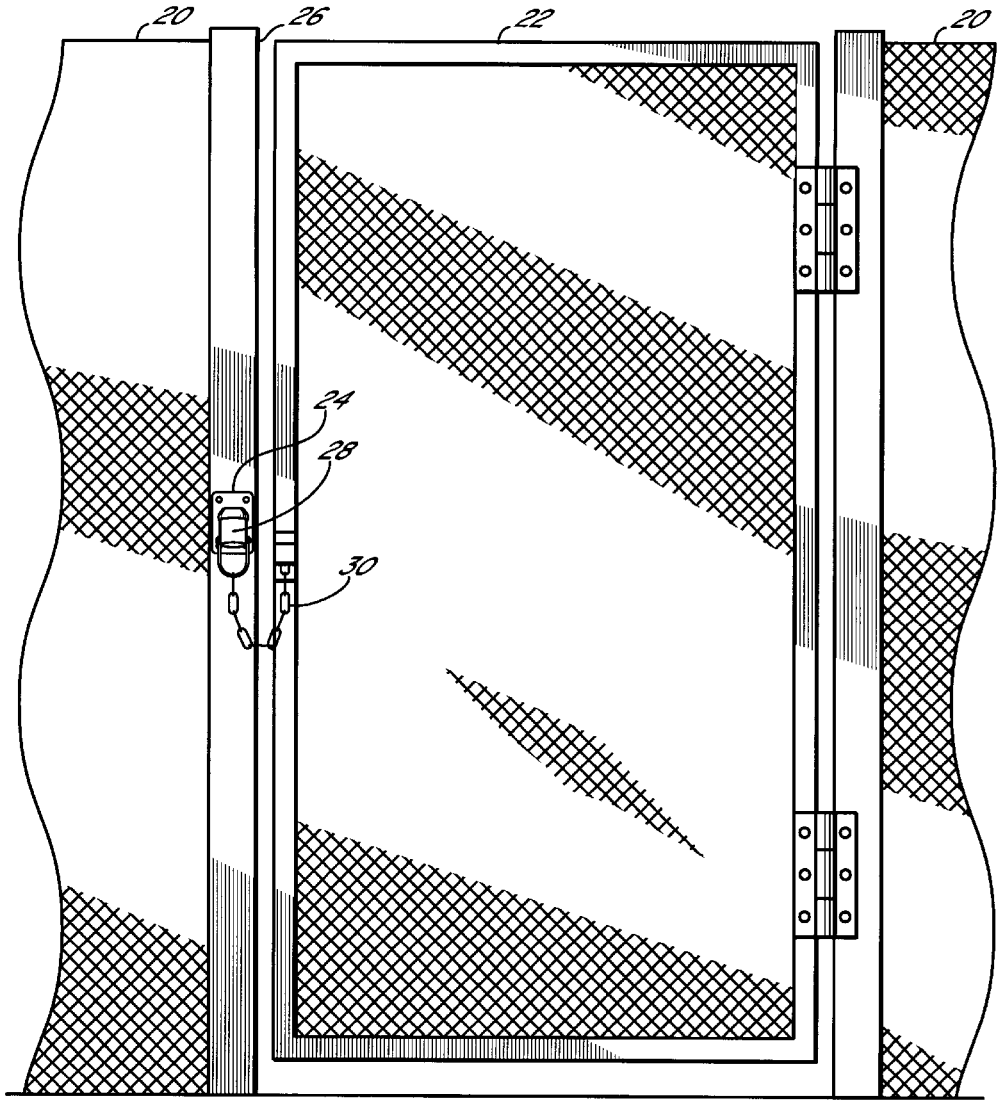
PRIOR ART FIG. 3
FIG. 3 is an environment in which a known connector is used.
Figure 4:
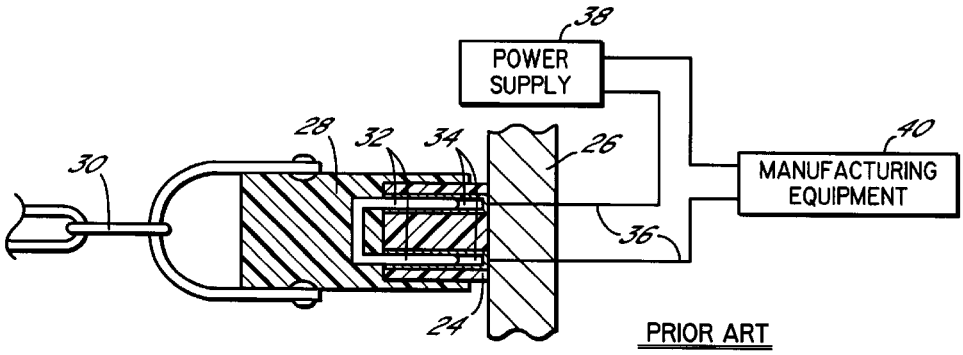
PRIOR ART FIG. 4
FIG. 4 is a schematic electrical diagram of a known connector.

Referring to FIG. 2, the principles of the invention of FIG. 1 are expanded by the use of another component, for example, a second key coupling 70. The second key coupling 70 has a first electrical connecting element comprised of a female key receptacle portion 71 on one end and a second electrical connecting element comprised of a male key plug portion 73 on an opposite end. The key plug portion 73 has a cavity 72 on one side or end that is sized and shaped to receive the extension 56*a* of the receptacle 46*a*. In addition, the pin sockets 58*a* in the receptacle 46*a* are sized and shaped to receive pins 74 of the second key plug 70 in an electrically conductive relationship. On the opposite end, the female key receptacle portion 73 includes an extension 76 that is sized and shaped to fit within the cavity 52*a* of the first key plug 50*a*. Further, within the extension 56*a*, pin sockets 78 are sized and shaped to receive the pins 52*a* of the first key plug 50*a* in an electrically conductive relationship. However, the size and shape of the cavity 54*a*, as well as the shape and spacing of the pins 52*a*, precludes the cavity 54*a* from receiving the receptacle 56*a*. Similarly, the size and shape of the cavity 62*a* in the shorting plug 48*a* and the spacing of the pins 66*a* makes it physically impossible to insert the extension 76 of the second key plug 70 into the shorting plug 48*a*.

The embodiment of FIG. 2 is especially useful in those applications where it is expected that two persons are required within the perimeter of the fence 20 at the same time. As each person enters the fenced area, he/she removes one of the key plugs 50*a*, 70 and carries the respective key plug with them while inside the perimeter of the fence 20. Removing either of the plugs 50*a*, 70 interrupts the continuity in a circuit connected to the wires 36. Further, continuity cannot be restored to the circuit connected to the wires 36 until both plugs 50*a*, 70 are reconnected between the receptacle 46*a* and the shorting plug 48*a* as each person leaves the perimeter of the fence 20, thereby guaranteeing that both persons are outside the perimeter of the fence 20. As will be appreciated, any number of different key plugs 50*a*, 70 may be stacked such that they form a chain of continuity through the connector 44.

The electrical connector or interlock of the present invention has the advantage of not being able to be inadvertently connected or switched while one or more persons remain undetected within the fence 20 perimeter and thus, is a more reliable and higher quality electrical interlocking connector than known devices.

While the present invention has been illustrated by a description of various preferred embodiments and while these embodiments have been described in considerable detail in order to describe the best mode of practicing the invention, it is not the intention of Applicant to restrict or in any way limit the scope of the appended claims to such detail. Additional advantages and modifications within the spirit and scope of the invention will readily appear to those skilled in the art. For example, in the described embodiment, the receptacle 24 is connected to the fixed end 26 of the fence, and the chain 30 is connected to the gate 22. As will be appreciated, the chain 30 can be connected to the fixed end 26 of the fence 20 and the receptacle 24 can be connected to the gate 22. Similarly, either the receptacle 24 or the shorting plug 28 can be connected to the end of the chain 30.

In addition, in the embodiment of FIG. 1, the size of the cavity 62 and spacing of the pins 66 is different from the size of the extension 56 and the spacing of the pin sockets 58. However, what is important is that the extension 56 cannot be connected to the shorting plug 48. That objective can be achieved by either making the cross-sectional profile of the extension 56 different from the cross-sectional profile of the cavity 62 or, making the spacing of the pin sockets 58 different from the spacing of the pins 66 or, making the cross-sectional profile of the pin sockets 58 different from the cross-sectional shape of the pins 66. Any one of those or other changes to the geometry of the extension 56, the cavity 62, the pin sockets 58 or the pins 66 will prevent the receptacle 46 from being electrically and mechanically coupled to the shorting plug 48. For example, the cross-sectional profile of the extension 56 and receiving cavity 54 may be one shape, such as, round; and the cross-sectional profile of the extension 60 and receiving cavity 62 may be any different shape, such as, oval, rectangular, triangular, etc. In another example, the pins 52 and receiving pin sockets 58 may be one shape, such as round; and the pins 66 and receiving pin sockets 64 may be a different shape, such as, rectangular, triangular, etc. While changing any one physical feature is sufficient to practice the present invention, changing more than one physical feature provides even more protection.

Therefore, the invention in its broadest aspects is not limited to the specific detail shown and described. Consequently, departures may be made from the details described herein without departing from the spirit and scope of the claims which follow.

What is claimed is:

1. An electrical connector assembly providing continuity in a circuit for use with a barrier including a gate providing access to an area surrounded by the barrier, the electrical connector comprising:

a first receptacle adapted to be mounted to a fixed portion of the barrier, the first receptacle having a curvilinear, first cross-sectional profile and adapted to be electrically connected to the circuit and the first receptacle having at least two first pin sockets having a first spacing therebetween;

a first key coupling comprising a first plug comprising a first cavity having a curvilinear cross-sectional profile substantially identical to the first cross-sectional profile of the first receptacle, thereby permitting the first receptacle to be inserted in the first cavity, and at least two first pins disposed in the first cavity and having the first spacing therebetween, the first pins being insertable in the first pin sockets upon the first receptacle being inserted into the first cavity of the first receptacle, and a second receptacle having a curvilinear, second cross-sectional profile different from the first cross-sectional profile, the second receptacle having at least two second pin sockets with a second spacing therebetween different from the first spacing; and a second plug adapted to be mounted to the gate comprising a second cavity having a curvilinear cross-sectional profile substantially identical to the second cross-sectional profile of the second receptacle, thereby permitting the second receptacle to be inserted in the second cavity, and at least two second pins disposed in the second cavity and having the second spacing therebetween, the second pins being electrically connected together and insertable in the second pin sockets upon the second receptacle being inserted into the second cavity of the second receptacle, whereby manually inserting the first receptacle into the first plug and the second receptacle into the second plug provides electrical continuity between the first pin sockets via the first key coupling and the second plug.

2. An electrical connector assembly providing continuity in a circuit for use with a barrier including a gate providing access to an area surrounded by the barrier, the electrical connector comprising:

a first receptacle adapted to be mounted to a fixed portion of the barrier, the first receptacle having a first cross-sectional profile and adapted to be electrically connected to the circuit and the first receptacle having at least two first pin sockets having a first spacing therebetween;

a first key coupling comprising a first plug comprising a first cavity having a cross-sectional profile substantially identical to the first cross-sectional profile of the first receptacle, thereby permitting the first receptacle to be inserted in the first cavity, and at least two first pins disposed in the first cavity and having the first spacing therebetween, the first pins being insertable in the first pin sockets upon the first receptacle being inserted into the first cavity of the first receptacle, and a second receptacle having a second cross-sectional profile different from the first cross-sectional profile, the second receptacle further having at least two second pin sockets with a second spacing therebetween different from the first spacing; a second key coupling comprising a second plug comprising a second cavity having a cross-sectional profile substantially identical to the second cross-sectional profile of the second receptacle, thereby permitting the second receptacle to be inserted in the second cavity, and at least two second pins disposed in the second cavity and having the second spacing therebetween, the second pins being insertable in the second pin sockets upon the second receptacle being inserted into the second cavity of the second receptacle, and a third receptacle having a third cross-sectional profile different from the first and second cross-sectional profiles, the third receptacle further having at least two third pin sockets with a third spacing therebetween different from the first and second spacings; and a third plug adapted to be mounted to the gate comprising a third cavity having a cross-sectional profile substantially identical to the third cross-sectional profile of the third receptacle, thereby permitting the third receptacle to be inserted in the third cavity, and at least two third pins disposed in the third cavity and having the third spacing therebetween, the third pins being electrically connected together and insertable in the third pin sockets upon the third receptacle being inserted into the third cavity of the third receptacle, whereby manually inserting the first receptacle into the first plug, the second receptacle into the second plug and the third receptacle into the third plug provides electrical continuity between the first pin sockets via the first and second key couplings and the third plug.

* * * * *